United States Patent [19]

Ishizuka et al.

[11] Patent Number: 4,828,019

[45] Date of Patent: May 9, 1989

[54] INDOOR UNIT FOR ROOM AIR CONDITIONERS AND AIR CONDITIONING SYSTEM USING THE SAME

[75] Inventors: Yutaka Ishizuka; Teruyuki Nagao, both of Konan, Japan

[73] Assignee: Diesel Kiki Co., Ltd., Tokyo, Japan

[21] Appl. No.: 120,312

[22] Filed: Nov. 13, 1987

[30] Foreign Application Priority Data

Nov. 28, 1986 [JP] Japan ..... 61-283668

[51] Int. Cl.[4] ..... F24H 3/06

[52] U.S. Cl. ..... 165/54; 98/389; 165/124

[58] Field of Search ..... 165/124, 126, 127, 54; 98/38.9; 237/46

[56] References Cited

U.S. PATENT DOCUMENTS

| | | | |
|---|---|---|---|
| 1,426,900 | 8/1922 | Neal | 237/46 X |
| 1,645,140 | 10/1927 | Herbruck | 237/46 X |
| 1,944,992 | 1/1934 | Miller | 165/54 X |
| 1,960,510 | 5/1934 | Ridgway | 165/124 |
| 2,322,041 | 6/1943 | Mayo | 165/127 X |
| 2,503,667 | 4/1950 | Hagen | 165/127 |
| 4,008,756 | 2/1977 | Hufford | 165/48.1 X |
| 4,568,652 | 5/1986 | Sakurai | 165/22 X |

*Primary Examiner*—William E. Tapolcai

*Attorney, Agent, or Firm*—Wenderoth, Lind & Ponack

[57] ABSTRACT

An air conditioning system includes a first indoor unit having a heat exchanger separating the inside space of a case in which air drawn from an air inlet is passed through the heat exchanger and then discharged from a plurality of air outlets, and a second indoor unit having no heat exchanger and connected with one of the air outlets via an intake duct. With this construction, the air to be distributed to a plurality of rooms is cooled or heated by a common heat exchanger. The air conditioning system thus constructed can be installed easily and has a relatively small number of structural components.

2 Claims, 1 Drawing Sheet

INDOOR UNIT FOR ROOM AIR CONDITIONERS AND AIR CONDITIONING SYSTEM USING THE SAME

BACKGROUND OF THE INVENTION

1. Field of the Invention

The present invention relates generally to air conditioning systems for houses or buildings, and more particularly to an indoor unit for room air conditioners and an air conditioning system using such indoor unit.

2. Prior Art

A known indoor unit for room air conditioners of this type, as disclosed in Japanese Patent Publication No. 51-13947, includes a heat exchanger disposed in a case or housing for cooling or heating air as the air is forced through the heat exchanger by a blower also disposed in the housing. Such indoor unit is installed in each of a plurality of rooms of a house or building to constitute an air conditioning system, and cold or hot water from a common cooling or heating source is circulated through the heat exchangers in the respective indoor units via a flow pipe and a return pipe.

The known indoor unit of the foregoing construction is disadvantageous in that one such indoor unit must be disposed in each of two rooms even when these rooms are adjoining either vertically or horizontally. With this duplex arrangement of the indoor units, a piping for the heat exchanger is also necessary for each room. As a result, a complicated installation work is necessary for building-up a whole air conditioning system using the known indoor units. The air conditioning system thus constructed has a large number of structural components.

SUMMARY OF THE INVENTION

It is accordingly an object of the present invention to provide an indoor unit for room air conditioners which is simple in construction and can be installed with utmost ease.

Another object of the present invention is to provide an air conditioning system for buildings that has a relatively small number of structural components.

A further object of the present invention is to provide an air conditioning system capable of air-conditioning two adjoining rooms concurrently by a single heat exchanger of the indoor unit disposed in only one room.

According to the first aspect of the present invention, there is provided an indoor unit for a room air conditioner, comprising a heat exchanger; a case receiving therein the heat exchanger and having defined therein an intake compartment and a discharge compartment separated by the heat exchanger, and further including at least one air inlet facing the intake compartment and at least two air outlets facing the discharge compartment; and a blower unit disposed in the discharge compartment and having a discharge opening connected with one of the air outlets.

According to the second aspect of the present invention, there is provided an air conditioning system for a house having a plurality of rooms, comprising: a first indoor uhit adapted to be disposed in one of the rooms and including a heat exchanger, a case receiving therein the heat exchanger and having defined therein an intake compartment and a discharge compartment separated by the heat exchanger, and further including at least one air inlet facing the intake compartment and at least two air outlets facing the discharge compartment, and a first blower unit disposed in the discharge compartment and having a discharge opening connected with one of the air outlets; a second indoor unit adapted to be disposed in another room and including a second blower unit and a blower casing receiving therein the second blower unit; and an intake duct having one end connected with the blower casing and the other end connected with the other air outlet.

With this construction, intake air drawn through the air inlet into the intake compartment is subjected to heat-exchanging relationship with the heat exchanger for being cooled or heated, then the temperature-controlled air is delivered from the discharge compartment through the two air outlets into two different rooms. Thus, concurrent air conditioning of plural rooms can be achieved by one and the same heat exchanger, and hence installation of another heat exchanger and associated piping is no longer necessary.

Many other advantages and features of the present invention will become manifest to those versed in the art upon making reference to the detailed description and the accompanying sheets of drawings in which a preferred structural embodiments incorporating the principles of the present invention is shown by way of illustrative example.

DETAILED DESCRIPTION

A preferred embodiment of the present invention is described below in greater detail with reference to the accompanying drawings.

Figure 2:
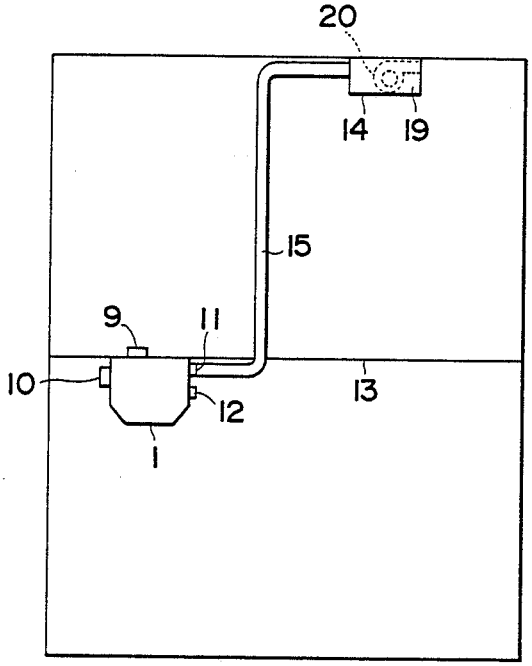
FIG. 2 is a diagrammatic front elevational view of a building air conditioning system incorporating the indoor unit shown in FIG. 1.

FIG. 2 shows an air conditioning system of the present invention which includes first and second indoor units 1, 14 installed in a two-storied house.

Figure 1:
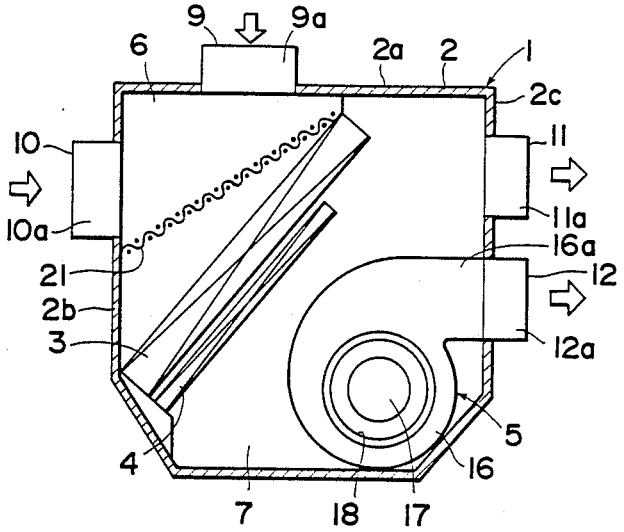
FIG. 1 is a schematic vertical cross-sectional view of an indoor unit embodying the present invention.

The first indoor unit 1 is disposed in a room on the first floor and, as shown in FIG. 1, includes a generally hollow rectangular case or housing 2 containing a heat exchanger 3 for cooling, a heat exchanger 4 for heating, and a blower unit 5.

The cooling heat exchanger 3 and the heating heat exchanger 4 have generally hollow rectangular shapes and are superimposed or laminated one on another. The cooling heat exchanger 3 extends obliquely across the case 2 and has one end engaging a top wall 2*a* of the case 2 at an intermediate portion thereof, the other end being located adjacent to the lower end of a side wall 2*b* adjoining the top wall 2*a*. The heating heat exchanger 4 is disposed on a downstream side of the cooling heat exchanger 3 in tandem relation to the latter. With this arrangement, the interior space of the case 2 is divided by the heat exchangers 3, 4 into two compartments 6, 7. One of the compartments 6 is defined by the left half of the top wall 2*a*, the side wall 2*b*, front and rear walls (not designated) and the heat exchangers 3, 4 and constitutes an intake compartment. The other compartment 7 constitutes a discharge compartment and is defined by the right half of the top wall 2*a*, an adjacent side wall 2*c*, a bottom wall (not designated), the front and rear walls and the heat exchangers 3, 4. The case 2 further has a pair of first and second air inlets 9, 10 facing the intake compartment 6, and a pair of first and second air outlets 11, 12 facing the discharge compartment 7. The intake compartment 6 includes a filter 21 disposed between the cooling heat exchanger 3 and the air inlets 9, 10.

The first and second air inlets 9, 10 and the first and secon air outlets 11, 12 are defined respectively in first and second air inlet tubes 9*a*, 10*a* and first and second air outlet tubes 11*a*, 12*a* that are connected with the case 2. The first air inlet tube 9*a* is connected with the top wall 2*a* and extends through a partition wall 13 (FIG. 2) into a room on the second floor so that the first air inlet 9 opens to the room interior on the second floor. The second air inlet tube 10*a* is connected with the side wall 2*b* and extends perpendicular to the first air inlet tube 9*a* so that the second air inlet 10 opens to the room on the first floor. Likewise, the first and second air outlets tubes 11*a*, 12*a* are connected with the side wall 2*a* and extend in a common direction opposite to the second air inlet tube 10*a* and hence the first and second air outlets 11, 12 open to the room on the first floor. The second air outlet 12 is connected with a discharge opening 16*a* of the blower unit 5.

The blower unit 5 is disposed in the discharge compartment 7 and includes a multi-winged fan rotatably disposed in a scrolled casing 16 and coupled in driven relation with a rive shaft of an electric motor 17. When the motor 17 is energized, the air in the dischage compartment 7 is drawn into the blower casing 16 through an intake hole 18 which is formed in a side wall of the casing 16, and then it is discharged from the second air outlet 12 through the discharge opening 16*a* to the room interior. At the discharge opening 16*a*, the blower casing 16 has a maximum diameter.

The second indoor unit 14 is disposed on the ceiling of the room on the second floor as shown in FIG. 2 and it includes a blower casing 19 in which a blower unit 20 is disposed. The blower unit 20 is substantially the same as the blower unit 5 in the first indoor unit 1. The blower casing 19 is connected with one end of an intake duct 15 extending between the vertically adjacent two rooms across the partition wall 13, the other end of the intake duct 15 being connected with the first air outlet 11. With the second indoor unit 14 thus constructed, the air is drawn from the discharge compartment 7 through the intake duct 15 into the blower casing 19 and then forced therefrom into the room interior.

As is apparent from the foregoing description, there is provided, within the room on the first floor, a first air circulation passage extending from the second air inlet 10, successively through the heat exchangers 3, 4 and the blower unit 5, to the second air outlet 12. Likewise, within the room on the second floor, there is provided a second air circulation passage extending from the first air inlet 9, successively through the heat exchangers 3, 4, the first air outlet 11 and the intake duct 15, to the second indoor unit 14. With the first and second air circulation passsages thus provided, when both rooms are to be air-conditioned, the heat exchangers 3, 4 are commonly used for these rooms and temperature-controlled air is distributed into the respective rooms at predetermined flow rates depending on the capacity of the blower units 5, 20.

In the illustrated embodiment, the number of the air inlet is two, but at leat one air inlet is sufficient. Further, the air outlets 11, 12 defined in the side wall 2*c* may be provided in any of the walls which define the air discharge compartment 7.

The indoor unit 1 may be used solely for the air-conditioning of a one-storied house in which instance one of the air inlets and one of the air outlets are closed.

Obviously, many modifications and variations of the present invention are possible in the light of the above teaching. It is therefore to be understood that within the scope of the appended claims, the invention may be practiced otherwise than as specifically described.

What is claimed is:

1. An air conditioning system for a two-story house of the type having at least two vertically adjoining rooms separated by a partition wall, said system comprising:

(a) a first indoor unit for being disposed in a lower room of the at least two vertically adjoining rooms, said first indoor unit including a heat exchanger, a case receiving therein said heat exchanger and having defined therein an intake compartment and a discharge compartment separated by said heat exchanger, said first indoor unit further including at least two air inlets opening into said intake compartment, a first air inlet of said at least two air inlets extending through a partition wall separating the at least two vertically adjoining rooms and opening into an upper room of the at least two rooms, a second air inlet of said at least two air inlets opening into the lower room of the at least two rooms, said first indoor unit having at least two air outlets opening into said discharge compartment, a first air outlet of said at least two air outlets opening into the lower room of the at least two rooms, and a first blower unit disposed in said discharge compartment and having a discharge opening connected with said first air outlet of said at least two air outlets;

(b) a second indoor unit for being disposed in the upper room of the at least two vertically adjoining rooms and including a second blower unit and a blower casing receiving therein said second blower unit; and (c) an intake duct having one end connected with said blower casing of said second indoor unit and the other end connected with the second air outlet of said first indoor unit.

2. An air conditioning system for a one-story house of the type having at least two horizontally adjoining rooms separated by a partition wall, said system comprising:

(a) a first indoor unit for being disposed in a first room of the at least two horizontally adjoining rooms, said first indoor unit including a heat exchanger, a case receiving therein said heat exchanger and having defined therein an intake compartment and a discharge compartment separated by said heat exchanger, said first indoor unit further including at least two air inlets opening into said intake compartment, a first air inlet of said at least two air inlets extending through a partition wall separating the at least two horizontally adjoining rooms and opening into a second room of the at least two rooms, a second air inlet of said at least two air inlets opening into the first room of the at least two rooms, said first indoor unit having at least two air outlets opening into said discharge compartment, a first air outlet of said at least two air outlets opening into the first room of the at least two rooms, and a first blower unit disposed in said discharge compartment and having a discharge opening connected with said first air outlet of said at least two air outlets;

(b) a second indoor unit for being disposed in the second room of the at least two horizontally adjoining rooms and including a second blower unit and a blower casing receiving therein said second blower unit; and (c) an intake duct having one end connected with said blower casing of said second indoor unit and the other end connected with the second air outlet of said first indoor unit.

* * * * *